US008618896B2

(12) United States Patent
Ahlert et al.

(10) Patent No.: US 8,618,896 B2
(45) Date of Patent: Dec. 31, 2013

(54) APPARATUS FOR TRIPPING AN ELECTRICAL SWITCH

(75) Inventors: Torsten Ahlert, Fürstenwalde (DE); Johannes Nestler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/469,221

(22) Filed: May 11, 2012

(65) Prior Publication Data

US 2012/0285805 A1 Nov. 15, 2012

(30) Foreign Application Priority Data

May 12, 2011 (DE) ..... 10 2011 075 727

(51) Int. Cl.
*H01H 9/00* (2006.01)

(52) U.S. Cl.
USPC ..... 335/172; 335/6; 335/21; 335/38; 335/174; 335/175

(58) Field of Classification Search
USPC ..... 335/6, 21, 35, 38, 172–176
See application file for complete search history.

(56) References Cited

U.S. PATENT DOCUMENTS

| | | | | |
|---|---|---|---|---|
| 5,103,198 | A | 4/1992 | Garcia | |
| 5,298,874 | A | 3/1994 | Morel | |
| 5,594,610 | A * | 1/1997 | Robirds et al. | 361/104 |
| 2001/0045879 | A1 | 11/2001 | Reichard et al. | |
| 2012/0026638 | A1 | 2/2012 | Ahlert | |

FOREIGN PATENT DOCUMENTS

| | | | |
|---|---|---|---|
| DE | 10013161 | A1 | 9/2001 |
| DE | 102009015126 | A1 | 10/2010 |
| DE | 102009015126 | A1 | 10/2010 |
| DE | 102009023619 | A1 | 12/2010 |
| EP | 1538653 | A1 | 6/2005 |

* cited by examiner

*Primary Examiner* — Ramon Barrera
(74) *Attorney, Agent, or Firm* — Harness, Dickey & Pierce, P.L.C.

(57) ABSTRACT

An apparatus for tripping an electrical switch is disclosed, which includes a selective tripping device and a power-storing mechanism. The electrical switch can be tripped by the selective tripping device by way of the power-storing mechanism.

5 Claims, 2 Drawing Sheets

APPARATUS FOR TRIPPING AN ELECTRICAL SWITCH

PRIORITY STATEMENT

The present application hereby claims priority under 35 U.S.C. §119 to German patent application number DE 10 2011 075 727.9 filed May 12, 2011, the entire contents of which are hereby incorporated herein by reference.

BACKGROUND

Electrical switches are used to switch electrical currents. One type of electrical switches are so-called circuit breakers, which can typically switch currents of 100 A and more. Circuit breakers are typically accommodated in a housing. The individual phases of the currents are typically switched in so-called switchgear units. To this end, a switchgear unit includes a housing, in which a moving contact and a fixed contact are accommodated, which can be mechanically separated and/or brought together in order to switch the currents off and/or on.

When separating the movement and fixed contact of a switchgear unit, an electric arc is produced which is cancelled out in a so-called arc chamber. The electric arc ionizes the gas of the arc chamber and generates an overpressure in the arc chamber. The arc chamber pressure is equivalent to the electric arc energy. On account of the overpressure, the hot gases flow out of the arc chamber through blow-out channels provided therefor.

It is known to use circuit breakers in power distribution and to allow this to be selectively switched off in the event of a short circuit. This is understood to mean that upstream circuit breakers only then trip if no downstream circuit breaker is able to separate the branch affected by the short-circuit. So-called selective tripping devices are used for selective shutdown.

From a specific tripping limit, the circuit breaker should be switched off by way of the selective tripping device. By way of example, known selective tripping devices use the gas pressure prevailing in the arc chamber during switching processes or they initiate a tripping by way of the magnetic powers prevailing in the event of a short-circuit. In order to open the electrical contacts of the circuit breaker, the selective tripping device actuates the switching lock. In order to trip the switching lock, a specific minimal power is needed which is to be applied. In order to apply this power, selective tripping devices typically have a power-magnifying mechanism.

SUMMARY

At least one embodiment of the invention provides an apparatus for tripping an electrical switch, which includes a selective tripping device without a power-magnifying mechanism and thus enables a simplified structure and space-saving compact design.

In at least one embodiment, the apparatus for tripping an electrical switch includes a selective tripping device and a power-storing mechanism, wherein the electrical switch can be tripped by the selective tripping device by way of the power-storing mechanism.

It is advantageous here that the selective tripping device of at least one embodiment has no power magnification and no interface for the switching lock of the electrical switch. This enables a space-saving, compact design. Components can be saved thereby providing a cost-saving.

BRIEF DESCRIPTION OF THE DRAWINGS

The invention is furthermore described with the aid of the figures below, in which.

Figure 1:
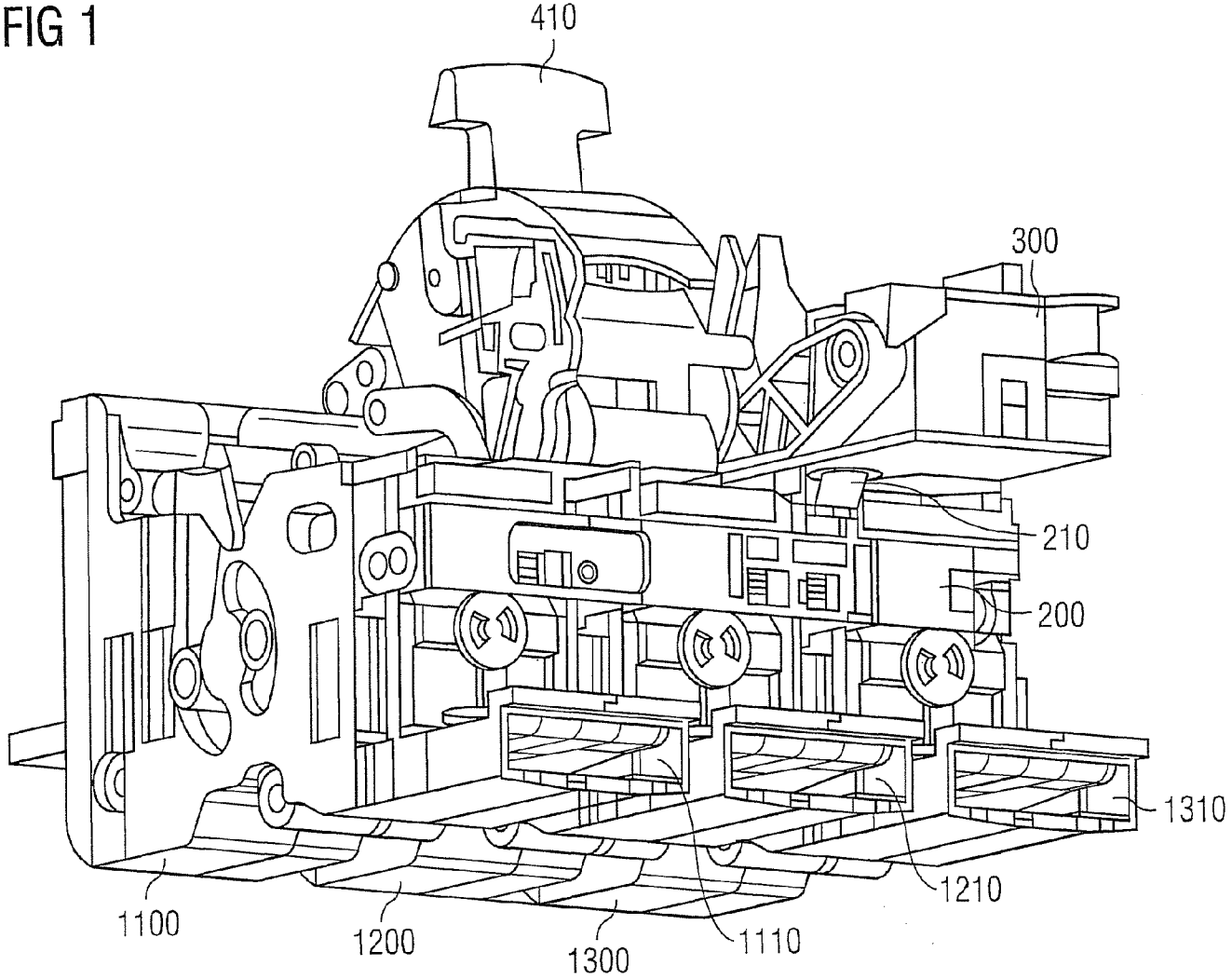
FIG. 1 shows an electrical switch with a selective tripping device and tripping unit having a power-storing mechanism.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In an embodiment of the invention, the apparatus also includes a tripping unit for opening or closing a current circuit through the electrical switch, wherein the tripping unit includes the power-storing mechanism and the power-storing mechanism interacts with the tripping unit for opening or closing the current circuit through the electrical switch.

It is advantageous here that the power-storing mechanism of a tripping unit is used to trip the electrical switch by means of the selective tripping device and as a result no further, separate component is required as a power-magnifying mechanism of the selective tripping device.

In a further embodiment, the power-storing mechanism of the apparatus is embodied to trip an electrical switch in a power-magnifying fashion. The power magnification of the power-storing mechanism can lie between factors 2 and 3.

In a further embodiment of the invention, the power-storing mechanism is embodied as a Maglatch module (e.g., a magnetic latch device). Similarly, in addition to a power-storing mechanism, it is possible for the apparatus for tripping an electrical switch also to include a Maglatch module (e.g., a magnetic latch device).

FIG. 1 shows a circuit breaker, which is composed of three switchgear units 1100, 1200, 1300. Movement and fixed contacts for switching the currents of the individual phases on and/or off are located in the switchgear units 1100, 1200, 1300. The individual switchgear units 1100, 1200, 1300 each include at least one blow-out channel 1110, 1210, 1310. When separating the movement and fixed contact of a switchgear unit 1100, 1200, 1300, an electric arc, which ionizes the gas in the respective arc chamber, is produced in the arc chambers of the switchgear units 1100, 1200, 1300. An overpressure is produced in the arc chambers and gas from the arc chambers is blown out through the blow-out channels 1110, 1210, 1310.

A moveable element with a damming body is located in the blow-out channel 1110, 1210, 1310 of each switchgear unit 1100, 1200, 1300 in order to detect the pressure impulse in the switchgear units 1100, 1200, 1300. The moveable element with the damming body is part of the selective tripping device 200 of the circuit breaker. One possible selective tripping device 200 is described in more detail for instance in DE 10 2009 015 126 A1, the entire contents of which are hereby incorporated herein by reference.

The selective tripping device 200 is connected to a power-storing mechanism 300 by way of the interface 210. The power-storing mechanism 300 in turn features an interface for the switching lock of the circuit breaker and provides the power needed to trip the circuit breaker. Similarly the handle 410 acts on the switching lock, by means of which it is manually possible to switch the circuit breaker on and/or off.

The selective tripping device 200 now detects a shock pressure from the arc chamber of one of the switchgear units 1100, 1200, 1300, therefore the circuit breaker is tripped by way of the power-storing mechanism 300.

Figure 2:
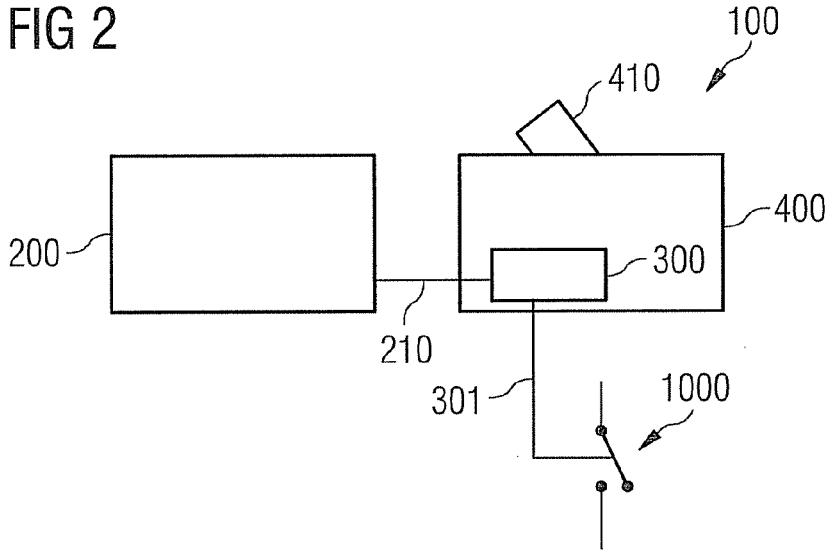
FIG. 2 shows a schematic representation of the apparatus for tripping an electrical switch using a selective tripping device and tripping unit having a power-storing mechanism.

FIG. 2 shows a schematic representation of the apparatus 100 for tripping an electrical switch 1000. The apparatus 100 includes a selective tripping device 200 and a power-storing mechanism 300. The selective tripping device 200 is connected to the power-storing mechanism 300 by way of the interface 210. When tripping the selective tripping device 200, the electrical switch 1000 is tripped by way of the power-storing mechanism 300. To this end, the power-storing mechanism 300 is connected to the electrical switch 1000 by way of the interface 301.

In FIG. 2 the apparatus additionally includes a tripping unit 400 for opening or closing the current circuit through the electrical switch 1000, wherein the tripping unit 400 includes the power-storing mechanism 300, and the power-storing mechanism 300 interacts with the tripping unit 400 in order to open or close the current circuit through the electrical switch

1000. The power-storing mechanism 300 is thus part of the tripping unit 400. The tripping unit 400 may likewise include a handle 410, by means of which the electrical switch 1000 can be switched on and/or off manually.

The power-storing mechanism 300 may act in a power-magnifying manner. By way of example, power in the range 2 to 4N can be applied to the interface 210 by the selective tripping device 200 for the power-storing mechanism 300. Power of 5 to 10N can be applied to the interface 301 between the power-storing mechanism 300 and electrical switch 1000. The power magnification of the power-storing mechanism 300 may thus lie between factors 2 and 3.

The power-storing mechanism 300 may be a Maglatch module of a circuit breaker. Circuit breakers with an electronic tripping unit (ETU) typically include a so-called Maglatch module, which mechanically converts the electronic signal of the ETU into tripping the electrical switch. According to FIG. 2, this means that the tripping unit 400 includes a Maglatch module 300 which is embodied in a power-storing and power-magnifying fashion.

Figure 3:
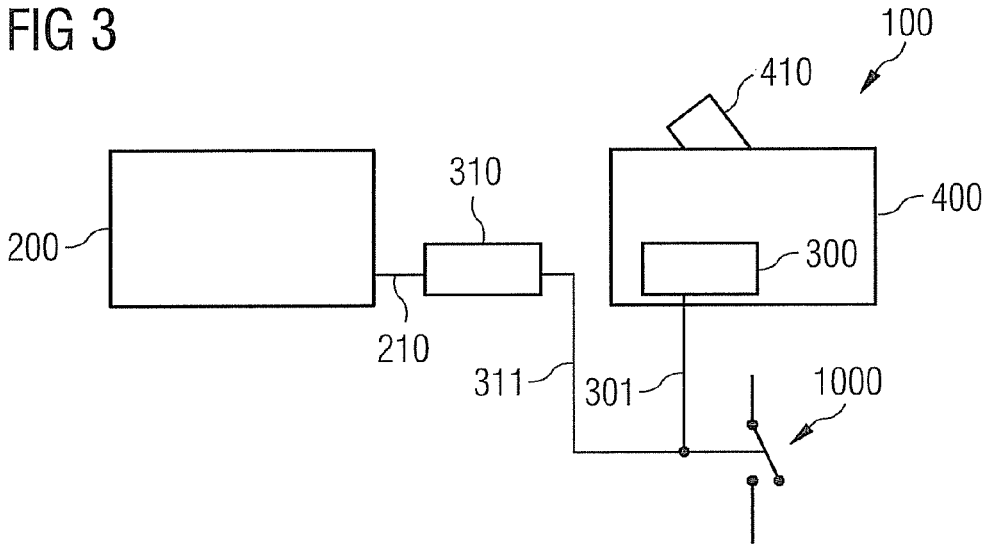
FIG. 3 shows a schematic representation of the apparatus for tripping an electrical switch using a selective tripping device and power-storing mechanism as well as a tripping unit having a power-storing mechanism.

FIG. 3 shows the apparatus 100 for tripping an electrical switch 1000 using a selective trigger 200 and a power-storing mechanism 310. The selective trigger 200 and power-storing mechanism 310 are connected to one another by way of the interface 210. The power-storing mechanism 310 is in turn connected to the electrical switch 1000 by way of the interface 311. In addition to the power-storing mechanism 310, the apparatus includes a tripping unit 400 for opening or closing a current circuit with a Maglatch module 300. This Maglatch module 300 is likewise connected to the electrical switch 1000 by way of an interface 301. The electrical switch 1000 can either be triggered by way of the selective tripping unit 200 and the power-storing mechanism 310 or by way of the tripping unit 400 with the Maglatch module 300.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus for tripping an electrical switch, comprising:

a selective tripping device; and a power-storing mechanism, the electrical switch being trippable via a force generated by the selective tripping device by way of the power-storing mechanism, the power-storing mechanism being configured to magnify a force of the selective tripping device used to trip the electrical switch, wherein the power-storing mechanism is a first Maglatch module.

2. The apparatus as claimed in claim 1, further comprising:

a tripping unit configured to open or close a current circuit through the electrical switch, wherein the tripping unit includes the power-storing mechanism, the power-storing mechanism being useable to interact with the tripping unit to open or close the current circuit through the electrical switch.

3. The apparatus as claimed in claim 2, wherein the power magnification of the power-storing mechanism lies between the factors 2 and 3.

4. The apparatus as claimed in claim 1, wherein the power magnification of the power-storing mechanism lies between the factors 2 and 3.

5. The apparatus as claimed in claim 1, further comprising:

a tripping unit configured to open or close a current circuit through the electrical switch, the tripping unit including a second Maglatch module, wherein the electrical switch is trippable by at least one of, the force generated by the selective tripping device and the power-storing mechanism, and a force generated by the tripping unit and the second Maglatch module.

* * * * *